US008894518B2

(12) United States Patent
Chung

(10) Patent No.: US 8,894,518 B2
(45) Date of Patent: Nov. 25, 2014

(54) BALL BAT

(71) Applicant: Min-Ju Chung, Taichung (TW)

(72) Inventor: Min-Ju Chung, Taichung (TW)

( * ) Notice: Subject to any disclaimer, the term of this patent is extended or adjusted under 35 U.S.C. 154(b) by 57 days.

(21) Appl. No.: 13/804,377

(22) Filed: Mar. 14, 2013

(65) Prior Publication Data

US 2014/0148281 A1 May 29, 2014

(30) Foreign Application Priority Data

Nov. 27, 2012 (TW) ..... 101222960 U

(51) Int. Cl.
*A63B 59/06* (2006.01)

(52) U.S. Cl.
CPC ..... *A63B 59/06* (2013.01)
USPC ..... 473/564; 473/566; 473/567

(58) Field of Classification Search
CPC ..... A63B 59/06; A63B 59/0014; A63B 59/0092; A63B 59/0088; A63B 2059/00; A63B 2059/06; A63B 2059/065; A63B 2059/0014; A63B 2059/0033; A63B 2069/0008
USPC ..... 473/457, 519, 520, 564–568
See application file for complete search history.

(56) References Cited

U.S. PATENT DOCUMENTS

| | | | | |
|---|---|---|---|---|
| 6,485,382 | B1 * | 11/2002 | Chen | 473/566 |
| 6,511,392 | B1 * | 1/2003 | Chohan | 473/564 |
| 6,609,984 | B1 * | 8/2003 | Tribble | 473/564 |
| 6,824,482 | B1 * | 11/2004 | Tribble | 473/564 |
| 6,878,080 | B2 * | 4/2005 | Chang | 473/564 |
| 6,899,648 | B2 * | 5/2005 | Chang | 473/564 |
| 6,929,573 | B1 * | 8/2005 | Chang | 473/567 |
| 7,052,419 | B2 * | 5/2006 | Chang | 473/566 |
| 7,201,679 | B2 * | 4/2007 | Nguyen | 473/520 |
| 7,311,620 | B1 * | 12/2007 | Heald et al. | 473/566 |
| 7,381,141 | B2 * | 6/2008 | Van Nguyen | 473/566 |
| 7,419,446 | B2 * | 9/2008 | Nguyen | 473/567 |
| 7,798,926 | B1 * | 9/2010 | Hsu | 473/566 |
| 7,942,764 | B2 * | 5/2011 | Chung | 473/564 |
| 8,197,365 | B2 * | 6/2012 | Tokieda | 473/566 |
| 8,226,505 | B2 * | 7/2012 | Burger | 473/520 |
| 8,277,343 | B2 * | 10/2012 | Chang | 473/566 |
| 8,313,397 | B2 * | 11/2012 | Watari et al. | 473/564 |

* cited by examiner

*Primary Examiner* — Mark Graham
(74) *Attorney, Agent, or Firm* — Trop, Pruner & Hu, P.C.

(57) ABSTRACT

A ball bat includes a hollow handle segment, a wooden barrel segment and a reinforcing segment. The handle segment has a handle section, a connecting section that has an outer diameter smaller than that of the handle section, and an abutment section that is disposed between the handle and connecting sections. The barrel segment has an abutment end section, a top end section that is opposite to the handle section of the handle segment, and an insertion hole that extends from the abutment end section toward the top end section. The connecting section is inserted into the insertion hole. The abutment end section abuts against the abutment section. The reinforcing segment is sleeved on the abutment end section.

8 Claims, 3 Drawing Sheets

BALL BAT

CROSS-REFERENCE TO RELATED APPLICATION

This application claims priority of Taiwanese Application No. 101222960, filed on Nov. 27, 2012.

BACKGROUND OF THE INVENTION

1. Field of the Invention

The invention relates to a ball bat, more particularly to a composite type of ball bat.

2. Description of the Related Art

A conventional composite ball bat disclosed in U.S. Pat. No. 6,929,573 comprises a tubular core of rigid materials having a first section and a second section. The second section of the core has a diameter greater than that of the first section. A covering member of semi-rigid materials has a first portion embracing the first section of the core to form a handle of the conventional composite ball bat, and a second portion embracing the second section of the core to form a striking portion of the conventional composite ball bat.

Although the conventional composite ball bat is light in weight, good equilibrium, and high structural strength for good performance when compared to a whole wooden bat, the difference between the diameters of the second section and the first section results in a relatively small thickness in the portion of the covering member that corresponds to the end portion of the second section proximate to the junction between the first and second sections. Due to the fact that the junction between the first and second sections would be subjected to stress when the conventional composite ball bat hits a ball, fracture may occur at the junction between the striking portion and the handle.

SUMMARY OF THE INVENTION

Therefore, the object of the present invention is to provide a durable ball bat.

Accordingly, a ball bat of the present invention comprises a hollow handle segment, a wooden barrel segment and a reinforcing segment. The handle segment extends along an axis and has a handle section, a connecting section that is opposite to the handle section along the axis and that has an outer diameter smaller than that of the handle section, and an abutment section that is disposed between the handle and connecting sections. The barrel segment extends along the axis and has an abutment end section, a top end section that is opposite to the handle section of the handle segment along the axis, and an insertion hole that extends from the abutment end section toward the top end section along the axis. The connecting section of the handle segment is inserted into the insertion hole. The abutment end section abuts against the abutment section of the handle segment. The reinforcing segment surrounds the axis and is sleeved on the abutment end section of the barrel segment.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
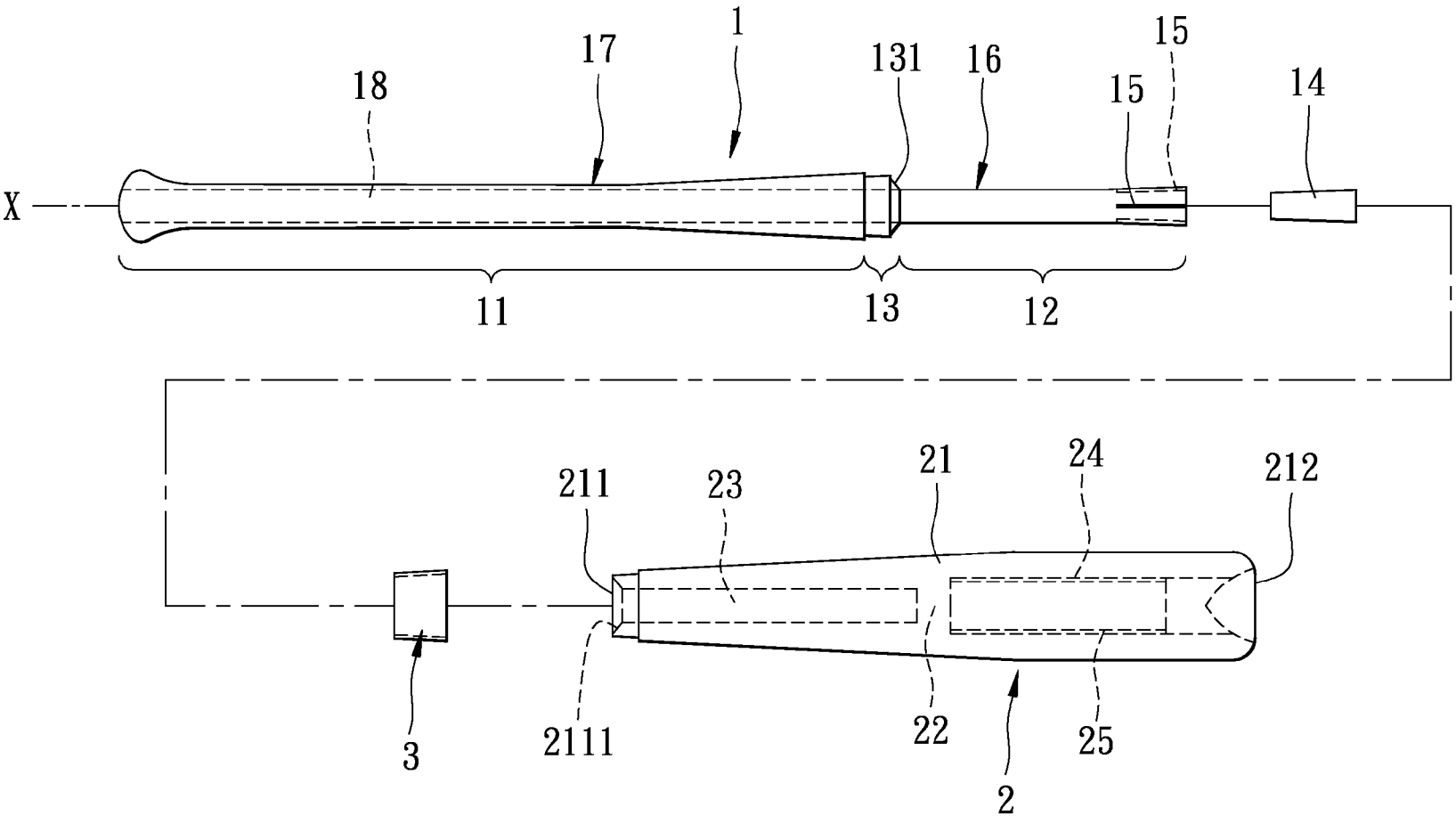
FIG. 1 is an exploded side view of a preferred embodiment of a ball bat according to this invention.
Figure 2:
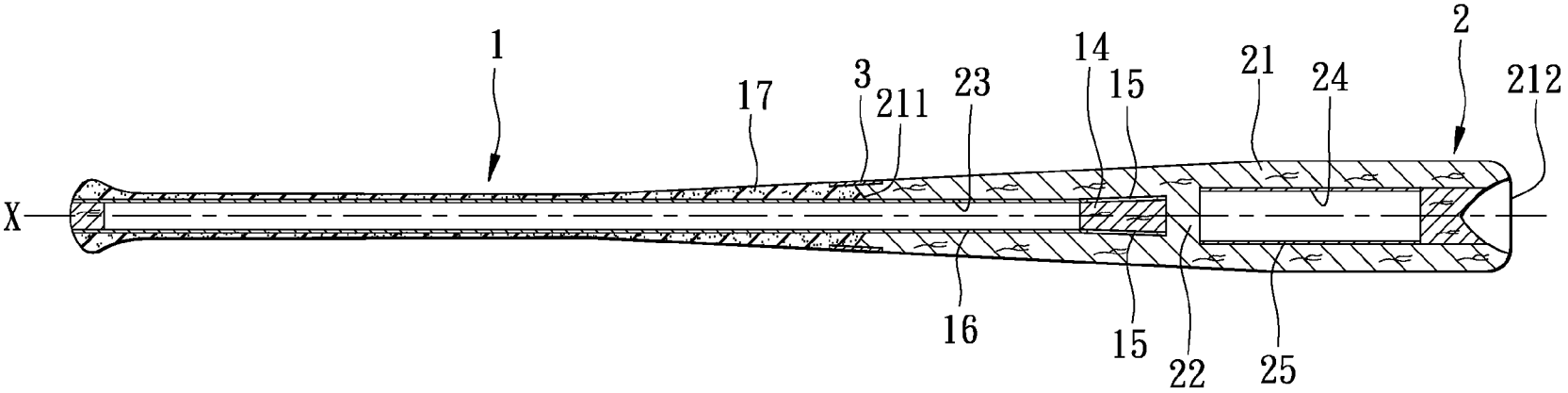
FIG. 2 is a sectional view of the preferred embodiment.
Figure 3:
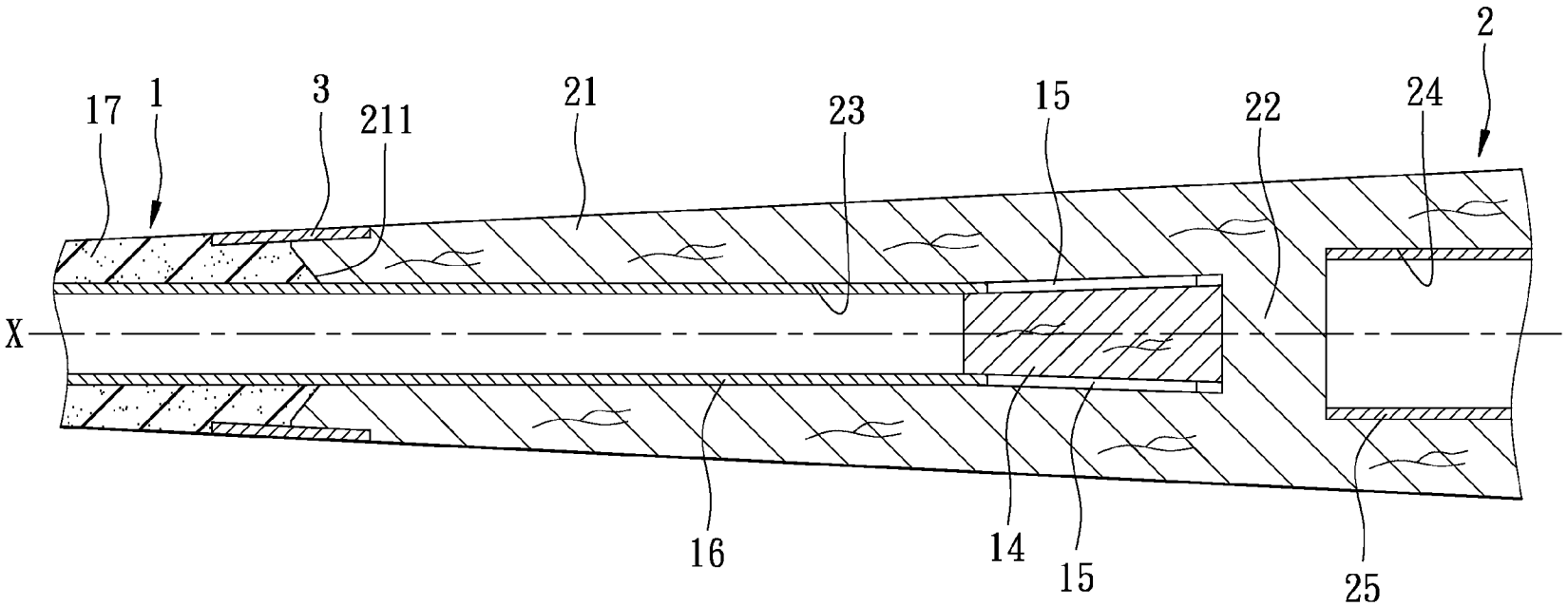
FIG. 3 is a fragmentary enlarged sectional view of FIG. 2.

Referring to FIGS. 1 to 3, the preferred embodiment of a ball bat according to this invention is shown to include a hollow handle segment 1, a wooden barrel segment 2 and a reinforcing segment 3.

The handle segment 1 extends along an axis (X), and has a handle section 11, a connecting section 12 that is opposite to the handle section 11 along the axis (X) and that has an outer diameter smaller than that of the handle section 11, and an abutment section 13 that is disposed between the handle and connecting sections 11, 12. The connecting section 12 has a hollow end opposite to the handle section 11 along the axis (X), and is formed with a plurality of angularly spaced-apart slits 15 that extend in the direction of the axis (X). The handle segment 1 further has an expanding member 14 inserted into the hollow end of the connecting section 12.

In this embodiment, the handle segment 1 includes a hollow handle body 17 and a core tube member 16 coupled with each other. The core tube member 16 and the handle body 17 are made of different materials respectively.

The core tube member 16 has a first portion 18 that is inserted into the handle body 17 and that cooperates with the handle body 17 to be configured as the handle section 11 and the abutment section 13, and a second portion that is connected to the first portion 18 and that is configured as the connecting section 12. In this embodiment, the core tube member 16 is made of carbon-fiber reinforced plastic material. In other embodiments of this invention, the core tube member 16 may be made of glass-fiber reinforced plastic material. The handle body 17 is made of a foaming material, such as polyurethane (abbreviated as PU), to improve grip comfort and shock absorption when the ball bat of the preferred embodiment hits a ball. However, the handle body 17 may be made of rigid aluminum alloy in other embodiments of this invention The barrel segment 2 extends along the axis (X), and has a surrounding wall 21 having an abutment end section 211 and a top end section 211 that is opposite to the abutment end section 212 along the axis (X), and an inner abutment wall 22 surrounded by the surrounding wall 21 and cooperates with the surrounding wall 21 to define an insertion hole 23 that extends from the abutment end section 211 toward the top end section 212 along the axis (X). The barrel segment 2 further has a retaining hole 24 defined cooperatively by the surrounding wall 21 and the inner abutment wall 22, extending along the axis (X) and spaced apart from the insertion hole 23 along the axis (X), and a core tube component 25 retained in the retaining hole 24, having an outer surrounding surface that abuts against the inner abutment wall 22, and having an outer diameter that is slightly greater than that of the connecting section 12.

The abutment end section 211 abuts against the abutment section 13. The expanding member 14 of the handle segment 1 is inserted into the hollow end of the connecting section 12 such that the hollow end of the connecting section 12 is urged to expand radially and outwardly to abut tightly against an inner surrounding surface of the surrounding wall 21 that faces the insertion hole 23. The expanding member 14 and the hollow end of the connecting section 12 abut against the inner abutment wall 22 of the barrel segment 2.

The abutment section 13 of the handle segment 1 has a first frustoconical surface 131 surrounding the axis (X), and the abutment end section 211 of the barrel segment 2 has a second frustoconical surface 2111 surrounding the axis (X) and abutting against the first frustoconical surface 131 of the abutment section 13 of the handle segment 1. The configuration of the first frustoconical surface 131 and the second frustoconical surface 2111 increases the contact area therebetween, so that the handle segment 1 can be coupled firmly to the barrel segment 2.

The reinforcing segment 3 is simultaneously sleeved on both the abutment section 13 of the handle segment 1 and the abutment end section 211 of the barrel segment 2. In this embodiment, the reinforcing segment 3 is made of metal. However, it should be noted herein that, in other embodiments of this invention, the core tube member 16 may be made of any fiber reinforced plastic material, such as carbon-fiber reinforced plastic material, glass-fiber reinforced plastic material, etc. Moreover, the reinforcing segment 3 may be sleeved only on the abutment end section 211.

When manufacturing the ball bat of this embodiment, the core tube member 16 is first placed in a molding machine to be integrally covered with foaming material to form the handle body 17. Next, the expanding member 14 is inserted loosely into the core tube member 16, while part of the reinforcing segment 3 is coupled to the barrel segment 2 that has the core tube component 25 mounted therein. After an adhesive is smeared onto the first frustoconical surface 131 and the second frustoconical surface 2111, the connecting section 12 is engaged with the insertion hole 23 until the first frustoconical surface 131 contacts the second frustoconical surface 2111. At this moment, the reinforcing segment 3 is simultaneously sleeved on the abutment section 13 of the handle segment 1 and the abutment end section 211 of the barrel segment 2. During the engagement between the connecting section 12 and the insertion hole 23, the expanding member 14 is abutted against and pushed by the abutment wall 22, there by urging the hollow end of the connecting section 12 to expand radially and outwardly and abut tightly against the inner surrounding surface of the surrounding wall 21 that faces the insertion hole 23, so that the core tube member 16 is firmly engaged with the insertion hole 23.

From the foregoing statements, it can be concluded that the ball bat of this invention has the following advantages:

1. By virtue of the reinforcing segment 3, the abutment end portion 211 of the barrel segment 2 can be securely and firmly coupled to the abutment section 13 of the handle segment 1 even when subjected to shock as the ball bat hits a ball so as to prevent damage to the ball bat.

2. The configuration of the first frustoconical surface 131 and the second frustoconical surface 2111 increases the contact area therebetween. Moreover, the hollow end of the connecting section 12 is urged to abut tightly against the inner surrounding surface of the surrounding wall 21. Therefore, the coupling strength between the handle segment 1 and the barrel segment 2 is significantly enhanced, which leads to a longer service life of the ball bat.

3. The provision of the core tube member 16 and the core tube component 25 results in light weight and sufficient structural strength of the hall bat. In this embodiment, the soft handle body 17 increases grip comfort of the ball bat.

While the present invention has been described in connection with what is considered the most practical and preferred embodiment, it is understood that this invention is not limited to the disclosed embodiment but is intended to cover various arrangements included within the spirit and scope of the broadest interpretation so as encompass all such modifications and equivalent arrangements.

What is claimed is:

1. A ball bat comprising:

a hollow handle segment extending along an axis, and having a handle section, a connecting section that is opposite to said handle section along the axis and that has an outer diameter smaller than that of said handle section, and an abutment section that is disposed between said handle and connecting sections;

a wooden barrel segment extending along the axis, and having an abutment end section, a top end section that is opposite to said handle section of said handle segment along the axis, and an insertion hole that extends from said abutment end section toward said top end section along the axis, said connecting section of said handle segment being inserted into said insertion hole, said abutment end section abutting against said abutment section of said handle segment;

a reinforcing segment surrounding the axis and sleeved on said abutment end section of said barrel segment;

said barrel segment includes a surrounding wall having said abutment end section and said top end section, and an inner abutment wall surrounded by said surrounding wall and cooperating with said surrounding wall to define said insertion hole;

said connecting section of said handle segment has a hollow end opposite to said handle section along the axis and formed with a plurality of angularly spaced-apart slits that extend in the direction of the axis; and said handle segment further has an expanding member inserted into said hollow end of said connecting section such that said hollow end of said connecting section is urged to expand radially and outwardly to abut tightly against an inner surrounding surface of said surrounding wall that faces said insertion hole.

2. The ball bat as claimed in claim 1, wherein:

said abutment section of said handle segment has a first frustoconical surface surrounding the axis; and said abutment end section of said barrel segment has a second frustoconical surface surrounding the axis; and abutting against said first frustoconical surface of said abutment section of said handle segment.

3. The ball bat as claimed in claim 1, wherein said reinforcing segment is sleeved on said abutment section of said handle segment and said abutment end section of said barrel segment.

4. The ball bat as claimed in claim 1, wherein said barrel segment further has:

a retaining hole defined cooperatively by said surrounding wall and said inner abutment wall, extending along the axis and spaced apart from said insertion hole along the axis; and a core tube component retained in said retaining hole, having an outer surrounding surface that abuts against said inner surrounding surface of said surrounding wall, and having an outer diameter that is greater than that of said connecting section.

5. The ball bat as claimed in claim 1, wherein said handle segment includes:

a hollow handle body; and a core tube member having a first portion that is inserted into said handle body and that cooperates with said handle body to be configured as said handle section and said abutment section, and a second portion that is connected to said first portion and that is configured as said connecting section.

6. The ball bat as claimed in claim 5, wherein said handle body is made of a foaming material.

7. The ball bat as claimed in claim 5, wherein said core tube member is made of a fiber reinforced plastic material.

8. The ball bat as claimed in claim 1, wherein said reinforcing segment is made of one of metal and fiber reinforced plastic material.

* * * * *